US007062184B2

(12) United States Patent
Ohtani et al.

(10) Patent No.: US 7,062,184 B2
(45) Date of Patent: Jun. 13, 2006

(54) IMAGE FORMATION DEVICE AND SHEET MATERIAL SELECTION DEVICE

(75) Inventors: Hideyuki Ohtani, Saitama-ken (JP); Shigeyuki Matsumoto, Saitama-ken (JP); Tadashi Kiyama, Saitama-ken (JP); Yukio Hayashi, Saitama-ken (JP); Toshihiro Suganuma, Saitama-ken (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/889,214

(22) Filed: Jul. 13, 2004

(65) Prior Publication Data

US 2005/0041989 A1 Feb. 24, 2005

(30) Foreign Application Priority Data

Jul. 14, 2003 (JP) ..... 2003-196735

(51) Int. Cl.
*G03G 15/00* (2006.01)
*G03G 15/16* (2006.01)
*G03G 15/20* (2006.01)

(52) U.S. Cl. ..... 399/45; 399/66; 399/69; 399/81

(58) Field of Classification Search ..... 399/45, 399/66, 69, 81
See application file for complete search history.

(56) References Cited

U.S. PATENT DOCUMENTS

| | | | | |
|---|---|---|---|---|
| 5,905,925 | A * | 5/1999 | Kawabata et al. | 399/45 |
| 6,205,299 | B1 * | 3/2001 | Kusaka et al. | 399/45 |
| 2002/0003973 | A1 * | 1/2002 | Saito | 399/167 |
| 2002/0071687 | A1 * | 6/2002 | Matsuura et al. | 399/45 |

FOREIGN PATENT DOCUMENTS

| | | |
|---|---|---|
| JP | A-3-100580 | 4/1991 |
| JP | A-6-253120 | 9/1994 |
| JP | 2655844 | 5/1997 |
| JP | 2820993 | 8/1998 |
| JP | 3089018 | 7/2000 |
| JP | A-2001-175089 | 6/2001 |

* cited by examiner

*Primary Examiner*—William J. Royer
(74) *Attorney, Agent, or Firm*—Morgan, Lewis & Bockius, LLP

(57) ABSTRACT

An IOT controller of an image formation device is provided with an NvRAM. Correction coefficients relating to various parameters, which are specified for each of paper types in advance, are stored in the NvRAM. The NvRAM is provided with a user setting region, and when it is desired to form an image at an unusual paper, parameters of this paper can be inputted by operation of a control panel. When image formation is to be implemented, the IOT controller, after selection of a paper type at the control panel, reads out correction coefficients of the parameters relating to the selected paper type from the NvRAM, implements transfer processing in accordance with these correction coefficients, and forms a high-quality image.

24 Claims, 4 Drawing Sheets

IMAGE FORMATION DEVICE AND SHEET MATERIAL SELECTION DEVICE

CROSS-REFERENCE TO RELATED APPLICATION

This application claims priority under 35 USC 119 from Japanese Patent Application No. 2003-196735, the disclosure of which is incorporated by reference herein.

BACKGROUND OF THE INVENTION

1. Technical Field

The present invention relates to an image formation device, such as a photocopier, a laser printer, a facsimile machine or the like, which utilizes an electrophotographic process.

2. Description of the Related Art

In an image formation device of a photocopier, laser printer, facsimile machine or the like that employs an electrophotography process, a toner image is formed at a photosensitive drum, this toner image is transferred to a recording sheet such as recording paper or the like, and an image is formed on the recording sheet by thermal fixing.

At such an image formation device, as a method for forming the image at the recording sheet, beside a method of direct transfer from the photosensitive drum to the recording sheet, there is a method which utilizes an intermediate transfer body, such as an intermediate transfer roller, an intermediate transfer belt or the like, and after initially transferring the toner image from the photosensitive body to the intermediate transfer body, subsequently transfers the toner image from the intermediate transfer body to the recording sheet.

In such transfer methods, a transfer member such as a transfer roller or the like is disposed to oppose an image-bearing member, such as the photosensitive drum, the intermediate transfer body or the like. A transfer electric field is formed at a rear face of the recording sheet by the transfer member, by applying charge (a bias voltage) of the opposite polarity to a static charge of the toner. Thus, the toner image is electrostatically transferred to a front face of the recording sheet.

In such image formation devices, various kinds of data are stored in storing means, this data is selectively read out, and processing for image formation is implemented.

For example, an image formation device has been proposed in which a plurality of image creation conditions are specified, adjustment values for color balance conditions are preparatorily stored in non-volatile storing means for each of the image creation conditions, the adjustment values for a color balance condition that is closest to the color balance condition of an original are read out from the non-volatile storing means, and an image creation process is implemented (see, for example, Japanese Patent No. 2,655,844).

Further, an image formation device has been proposed in which, when a power supply to a copier device is turned on, initial mode-setting means sets the copier device to a predetermined transfer process operation mode, and rewriting means changes, for example, information at information-preserving means from information which designates a second storage region to information which designates a first storage region. Thereafter, when there is input from mode-inputting means, input mode-setting means correspondingly specifies a change of a mode set at the copier device to the inputted mode. At the same time, one of the storage regions, which is designated by the information preserved by the information-preserving means, is overwritten. When the power supply to the copier device is turned off, a mode at the moment of turning the power off is preserved at the one storage region immediately after the power is turned off. Thereafter, if there is a reset instruction from mode reset-instructing means while the power is on, reset mode-setting means updates to set the copier device to the mode in the other storage region. Thus, an operator can automatically set the copier device to the mode of a previous session simply by inputting a reset instruction at the mode reset-instructing means. (See, for example, Japanese Patent No. 3,089,018.)

An image formation device has further been proposed in which, when jam-detecting means disposed on a transfer member path detects a jam, a jam signal is stored in a non-volatile memory, and when an image formation task is to be commenced after jam processing, bias of transferring means is switched to an opposite polarity in accordance with the signal in the non-volatile memory (see, for example, Japanese Patent Application Laid-Open (JP-A) No. 3-100580).

Further still, a facsimile device has been proposed in which a past state of working of heating means is stored in storing means, and a state of working of the heating means is controlled on the basis of stored contents of the storing means (see, for example, JP-A No. 6-253120).

Now, when a toner image is formed at a recording sheet by electrostatic transfer, one factor which has a great effect on the electrostatic transfer of the toner (the toner image) is variations in a resistance value of the transfer member. Generally, with a conductive transfer member, the longer a duration of current flow, the higher the resistance value. The resistance value also becomes lower when temperature rises, and the resistance value is greatly altered by environmental conditions such as temperature, humidity and the like.

Furthermore, electrical characteristics of the recording sheet also have a great effect on the electrostatic transfer of toner. That is, a resistance value of the recording sheet is a factor which has a great effect on a transfer electric field.

In an image formation device, if the same bias voltage is applied even though the various factors that affect the transfer field have changed, an appropriate transfer field cannot be applied between the image-bearing member and the recording sheet, and transfer efficiency deteriorates. At such a time, a lowering of quality of the image that is formed on the recording sheet occurs.

Accordingly, a toner image transfer device has been proposed in which effect factor-detecting and -inputting means is provided. The effect factor-detecting and -inputting means detects and inputs factors that have effects on transfer of toner images. Initial transfer parameters, which are used for transfer of a toner image, are determined on the basis of values from this effect factor-detecting and -inputting means, and correction transfer parameters are specified on the basis of correction values which are inputted in order to correct the initial transfer parameters. A toner image on an image-bearing body is transferred to the recording sheet in accordance with the initial transfer parameters and the correction transfer parameters. See, for example, JP-A No. 2001-175089.

However, in image formation devices, not only common recording sheets such as ordinary paper, high-quality paper, recycled paper, transparencies and the like are used. Users can also select and use, for example, heavy papers, film-coated papers and the like. Even when different recording sheets are used by respective users in this manner, high-quality image formation is desired. In consequence, because the users have to input various parameters on each occasion of image formation, operations for image formation are more complicated, and high-quality images may not always be obtained.

SUMMARY OF THE INVENTION

The present invention has been devised in consideration of the circumstances described above, and provides an image formation device with which formation of high-quality images at a user's choice of recording sheets is enabled.

In order to achieve the object described above, the present invention is an image formation device which includes an image-bearing body at which an electrostatic latent image is formed by a light exposure section, a development section which forms a toner image in correspondence with the electrostatic latent image at the image-bearing body, a transfer section which transfers the toner image that has been formed at the image-bearing body to a sheet-form recording medium via an intermediate transfer body, and a fixing section which thermally fixes the toner image that has been transferred by the transfer section to the sheet-form recording medium. The image formation device also includes non-volatile memory, a selection section and a control section. The non-volatile memory is a section at which parameters of the transfer section and the fixing section, which change with respective sheet-form recording media, are preparatorily specified and stored in association with the respective sheet-form recording media. The selection section selects, from the plurality of sheet-form recording media for which the parameters are stored at the non-volatile memory, the sheet-form recording medium that is to be used in transfer of the toner image. The control section reads from the non-volatile memory the parameters of the sheet-form recording medium that has been selected by the selection section, and controls the transfer section and the fixing section in accordance with the parameters that have been read.

According to this invention, various parameters are differently specified in advance for each of the sheet-form recording media, and the specified parameters are stored in the non-volatile memory.

Hence, parameters are set in accordance with a sheet-form recording medium that is selected, by the selection section, from the sheet-form recording media whose parameters are recorded in the non-volatile memory. As a result, it is possible, by simple operations, to always form high-quality images on desired types of sheet-form recording media.

An image formation device to which the present invention as described above is applied may be a device which includes: a primary intermediate transfer body which is in contact with a plurality of the image-bearing body and to which the toner image is transferred from the image-bearing bodies; and a secondary intermediate transfer body which is in contact with the primary intermediate transfer body and to which the toner image is transferred from the primary intermediate transfer body, and which is in contact with the sheet-form recording medium and transfers the toner image to the sheet-form recording medium.

Further, the present invention may include: an input section for inputting parameters; and a writing section which writes the parameters that have been inputted by the input section to a vacant region which is preparatorily provided in the non-volatile memory. The selection section is capable of selecting the parameters that have been written to the vacant region of the non-volatile memory and/or a sheet-form recording medium specified by these parameters.

According to this invention, when a parameter is inputted from the input section, that parameter is written to the vacant region, which has been provided in advance at the non-volatile memory, by the writing section.

When parameters have been written to the vacant region of the non-volatile memory, the selection section can select these parameters and/or a sheet-form recording medium which is specified by these parameters.

Consequently, it is possible to form a high-quality image at a desired sheet-form recording medium.

The input section employed in the present invention as described above may utilize a control panel of a device which is provided with a display section. Moreover, the input section is not limited thus, and may be means for inputting to the image formation device via a network or the like.

Further yet, in the present invention, correction coefficients for providing the parameters may be recorded at the non-volatile memory.

Here, the transfer section may include a portion for controlling a constant voltage on the basis of current detection, and the parameters that are applied in the present invention may include a constant voltage control correction coefficient, which sets a transfer voltage of the transfer section. Moreover, this constant voltage correction coefficient may include a paper size correction coefficient, and the constant voltage correction coefficient may include a paper leading end detection correction coefficient.

Further still, the parameters may include one or more of a paper charge removal voltage-setting coefficient, a paper conveyance speed selection coefficient, a loop regulation coefficient and a coefficient for temperature regulation of the fixing section.

That is, the parameters that are applied in the present invention can be respectively different for each type of sheet-form recording medium and, as long as a constant transfer efficiency can be obtained regardless of types of sheet-form recording mediums, arbitrary variables and coefficients can be used as the parameters.

DETAILED DESCRIPTION OF THE INVENTION

Figure 1:
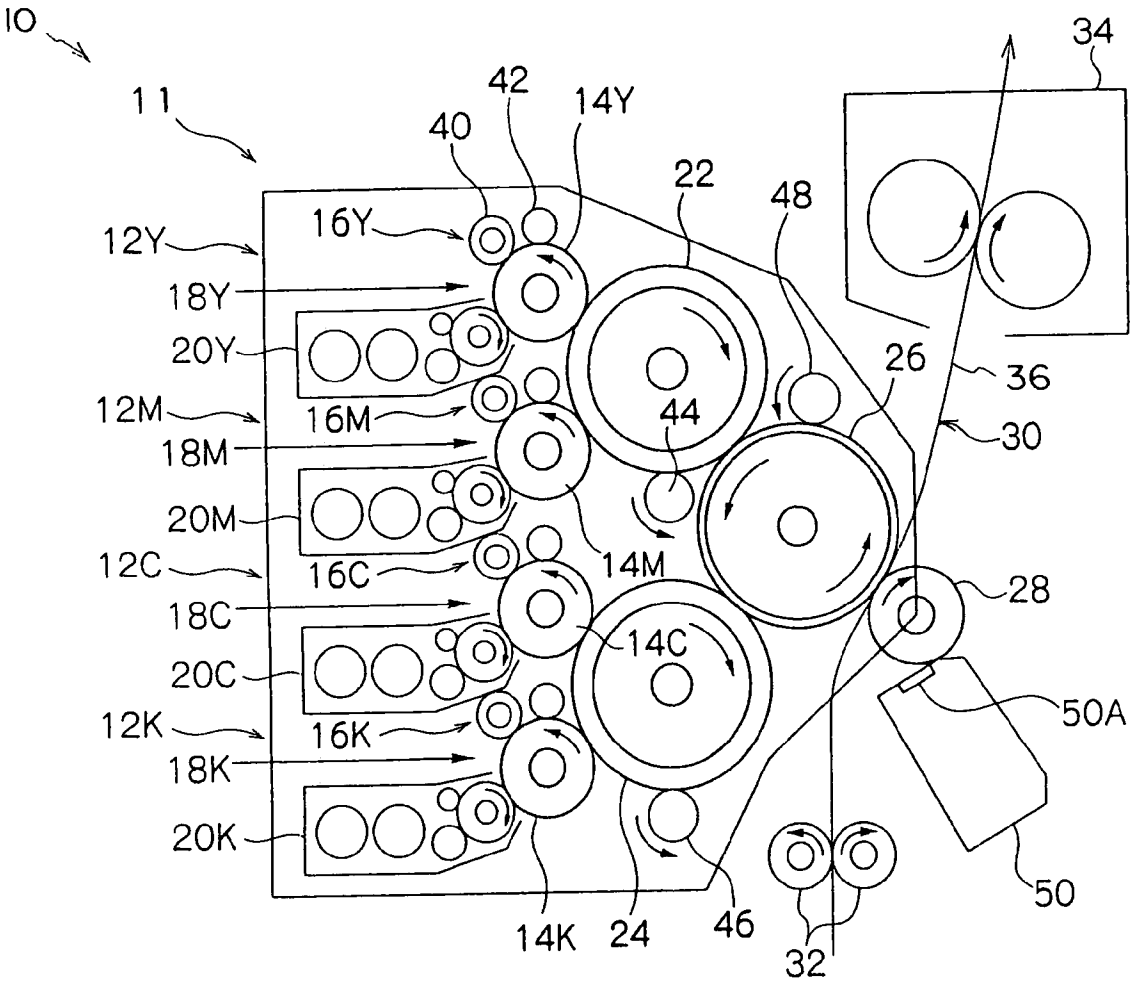
FIG. 1 is a schematic structural view of principal parts of a laser printer in which a present embodiment is applied.

Herebelow, an embodiment of the present invention will be described. FIG. 1 shows schematic structure of an image output terminal (IOT) 11 which is provided at a laser printer 10, which is employed as an image formation device in the present embodiment. The arc-form arrows shown in FIG. 1 represent rotation directions of corresponding rotating members.

The IOT 11 of the laser printer 10 is structured to include image formation units 12 (12Y, 12M, 12C and 12K), for the respective colors yellow (Y), magenta (M), cyan (C) and black (K), charging units 16 (16Y, 16M, 16C and 16K) for primary charging, and unillustrated laser light units. The image formation units 12 are equipped with photosensitive body drams 14 (14Y, 14M, 14C and 14K). The charging units 16 are in contact with the respective corresponding photosensitive body drums 14. The laser light units irradiate laser lights 18 (18Y, 18M, 18C and 18K) at the corresponding photosensitive body drums 14.

The IOT 11 is structured to further include developing units 20 (20Y, 20M, 20C and 20K), a primary intermediate transfer roller 22, another primary intermediate transfer roller 24, a secondary intermediate transfer roller 26 and a final transfer roller 28. The developing units 20 accommodate developing agents which include toner of the respective color components. The primary intermediate transfer roller 22 is in contact with the photosensitive body drums 14Y and 14M and the primary intermediate transfer roller 24 is in contact with the photosensitive body drums 14C and 14K. The secondary intermediate transfer roller 26 is in contact with the primary intermediate transfer rollers 22 and 24, and the final transfer roller 28 is in contact with the secondary intermediate transfer roller 26.

Note that in the laser printer 10 relating to the present embodiment, the photosensitive body drums 14, the charging units 16, the developing units 20, the primary intermediate transfer rollers 22 and 24, and the secondary intermediate transfer roller 26 are structured as a process cartridge (a customer replaceable unit (CRU)) in which these components are integrally provided.

The photosensitive body drums 14 are disposed at equal intervals from one another along a vertical direction (the vertical direction of the drawing of FIG. 1). The primary intermediate transfer rollers 22 and 24 and the secondary intermediate transfer roller 26 are disposed such that respective rotation axes thereof are parallel to rotation axes of the photosensitive body drums 14.

At the aforementioned laser light units, the laser lights IS of the respective colors are modulated in accordance with image information for each color, which is inputted from an image processing unit (not shown), and are respectively irradiated to the photosensitive body drums 14 of the corresponding colors. Hence, in the vicinities of the photosensitive body drums 14, an image-forming process is implemented for each color by a well-known electrophotographic technique, as follows.

At such times, the photosensitive body drums 14 are driven to rotate at predetermined rotation spades (for example, 95 mm/sec.). First, DC voltages of a predetermined level of charging (for example, around −800 V) are applied to the charging units 16, as a result of which surfaces of the photosensitive body drums 14 are uniformly charged to predetermined levels. Note that, in the present embodiment, it is possible to apply just a DC voltage to the charging units 16, and it is possible to superimpose an AC component on a DC component.

Next, the laser lights 18 from the laser light units corresponding to the respective colors are irradiated to the surfaces of the photosensitive body drums 14 that have been set to uniform surface potentials, and electrostatic latent images are formed in accordance with the image information for each color.

Thus, the photosensitive body drums 14 are subjected to charge removal until the surface potentials of regions that are exposed by the laser lights are at a predetermined level (for example, around 60 V or less).

Hence, the electrostatic latent images that have been formed at the surfaces of the photosensitive body drums 14 are developed by the corresponding developing units 20, and the electrostatic latent images are rendered visible as toner images of the respective colors on the photosensitive body drums 14.

Then, of the toner images of each color that are formed on the photosensitive body drums 14, the yellow and magenta toner images formed at the photosensitive body drums 14Y and 14M are electrostatically primary-transferred to the primary intermediate transfer roller 22, and the cyan and black toner images formed at the photosensitive body drums 14C and 14K are electrostatically primary-transferred to the primary intermediate transfer roller 24.

Here, a transfer bias power source (not shown) is connected to the primary intermediate transfer roller 22 and the primary intermediate transfer roller 24. A transfer bias from the transfer bias power source is applied to each of the primary intermediate transfer rollers 22 and 24 at the time of primary transfer of the toner images.

The toner images formed on the primary intermediate transfer rollers 22 and 24 are electrostatically secondary-transferred onto the secondary intermediate transfer roller 26. Thus, the toner images are formed from the single color images into a four-color image, with each of the colors yellow, magenta, cyan and black, on the secondary intermediate transfer roller 26.

Similarly to the primary intermediate transfer rollers 22 and 24, a transfer bias power source is also connected to the secondary intermediate transfer roller 26, and a transfer bias is applied to the secondary intermediate transfer roller 26 at the time of secondary transfer of the toner images.

The toner image formed on the secondary intermediate transfer roller 26 is tertiary-transferred (a final transfer) by the final transfer roller 28 to a paper 36, which passes along a paper conveyance path 30. This paper 36 is employed as a sheet-form recording medium. The paper 36 passes through an unillustrated paper-feeding stage, passes between paper conveyance rollers 32, and is fed in to a nipping portion between the secondary intermediate transfer roller 26 and the final transfer roller 28. After this tertiary transfer, the toner image that has been formed on the paper 36 is fixed by a fixing unit 34. Thus, the image formation process is completed. Similarly to the primary intermediate transfer rollers 22 and 24 and the secondary intermediate transfer roller 26, a transfer bias power source is connected to the final transfer roller 28, and at the time of the tertiary transfer of the toner image, a transfer bias from the transfer bias power source is applied to the final transfer roller 28.

Now, as shown in FIG. 1, each of the charging units 16 relating to the present embodiment is provided with a charging roller 40 and a brush roller 42. The charging roller 40 charges up the photosensitive body drum 14. The brush roller 42 is at an upstream side relative to the charging roller 40. At the brush roller 42 of the charging unit 16, extraneous substances such as residual toner, carrier particles and the like on the photosensitive body drum 14 are removed, so that extraneous substances on the photosensitive body dram 14 will not be transferred to the charging roller 40.

Further, primary intermediate brush rollers 44 and 46 and a secondary intermediate brush roller 48 are disposed in contact with the primary intermediate transfer rollers 22 and 24 and the secondary intermediate transfer roller 26, respectively. The primary intermediate brush rollers 44 and 46 and the secondary intermediate brush roller 48 temporarily retain extraneous materials such as residual toner and the like that have adhered to the surfaces of the respective rollers.

Further still, a cleaning apparatus 50 is provided at the final transfer roller 28. The cleaning apparatus 50 includes a blade 50A, and employs a blade cleaning technique.

Figure 2:
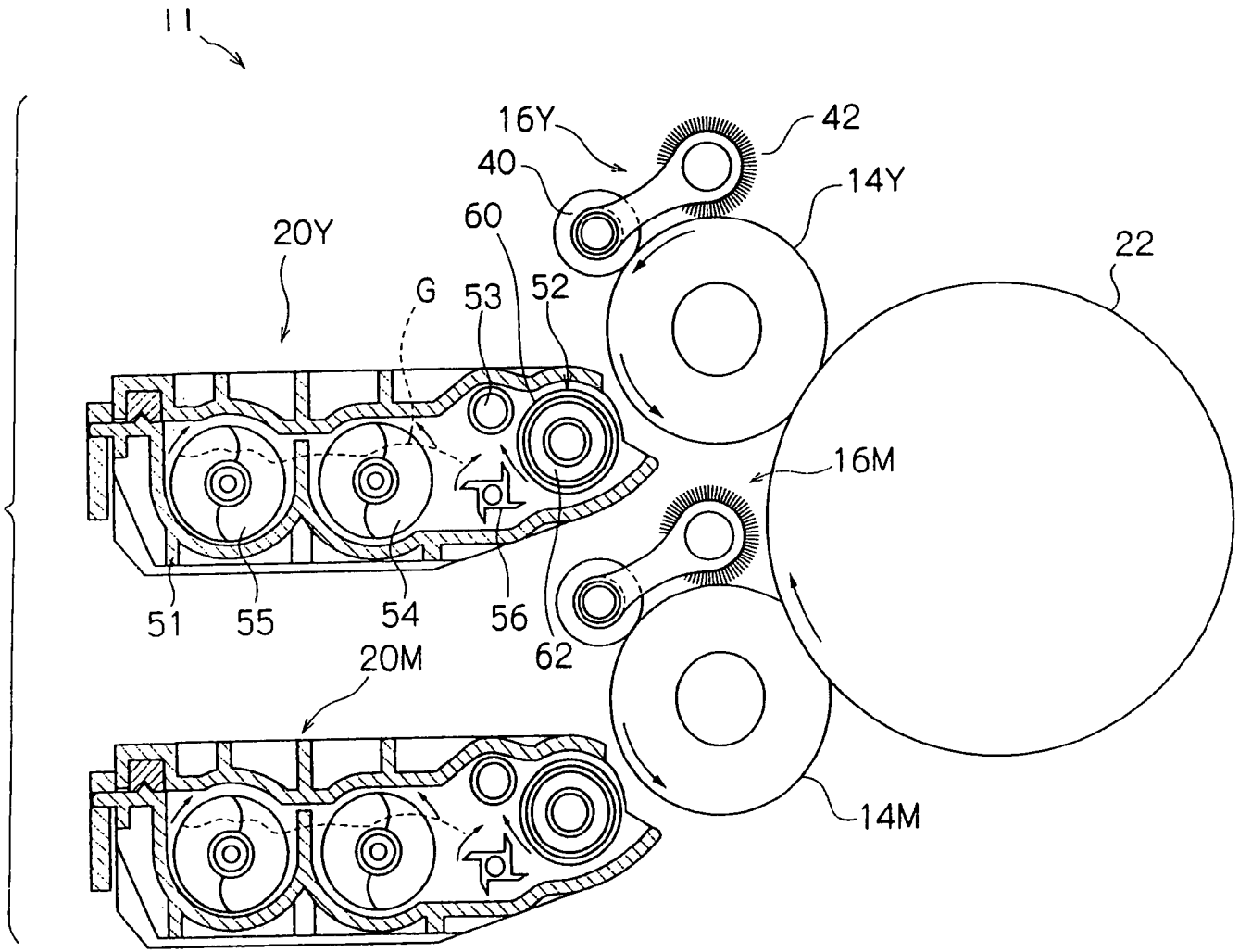
FIG. 2 is a schematic structural view of a vicinity of photosensitive drums.

Hereafter, the charging units 16 and the developing units 20 provided at the laser printer 10 will be described with reference to FIG. 2. Note that, in FIG. 2 too, directions of rotation of rotating components are represented by arc-form arrows.

Each of the developing units 20 includes a housing 51, a developer roller 52, a layer thickness regulation roller 53, two augurs 54 and 55, and a paddle wheel 56. The housing 51 accommodates a developing agent G, which includes a non-magnetic toner and a magnetic carrier. The developer roller 52 is disposed to face an opening portion of the housing 51. The layer thickness regulation roller 53 regulates thickness of a layer of the developing agent G which is carried on the developer roller 52. The augurs 54 and 55 transport the developing agent G while agitating the same. The paddle wheel 56 supplies the developing agent G to the developer roller 52.

At the developer roller 52, a non-magnetic developer sleeve 60 and a magnetic roller (magnet roll) 62 are disposed in a state in which positions thereof are fixed. The developer sleeve 60 is formed in a hollow tubular shape which is disposed to be rotatably driveable in the vicinity of the opening portion of the housing 51. At the magnetic roller 62, a plurality of magnets are disposed at predetermined angles in the hollow interior of the developer sleeve 60.

A bias power source (not shown) is connected to the developer sleeve 60. Thus, a predetermined developing bias (in the present embodiment, a bias voltage in which an AC component is superimposed on a DC component) is applied to the developer sleeve 60.

At each of the charging units 16, the charging roller 40, which charges up the photosensitive body drum 14, and the brush roller 42, which is provided at the upstream side of the charging roller 40, are rotatably supported at a pair of axle members (not shown).

In the present embodiment, the charging roller 40 is provided with a non-magnetic shaft, a sponge-like conductive resilient member, and a tubular surface layer film. The conductive resilient member is provided at an outer periphery of the non-magnetic shaft, and the surface layer film covers the conductive resilient member. An unillustrated charging bias power source is connected to the non-magnetic shaft. A charging bias with differing polarities is applied from the charging bias power source to the non-magnetic shaft.

Here, a technique for applying bias to the charging roller 40 is to apply a negative charging bias at times of image formation, and to apply a positive charging bias at times of cleaning.

The brush roller 42 of the present embodiment is provided with scraping bristles, which serve as a brush-like member, at an outer periphery of a nonmagnetic shaft. Hence, the brush roller 42 rotates to follow rotation of the photosensitive body drum 14, due to frictional force which acts between the scraping bristles and the photosensitive body drum 14. Further, a removal bias power source is connected to the brush roller 42, and applies a removing bias with differing polarities.

Here, a technique for applying bias to the brush roller 42 is to apply a negative removal bias at a time of image formation, so as to temporarily recover toner, whose polarity has been reversed, from the surface of the photosensitive body drum 14. Until cleaning is commenced, this toner is retained and then, during cleaning, a positive charge removal bias is applied.

Figure 3:
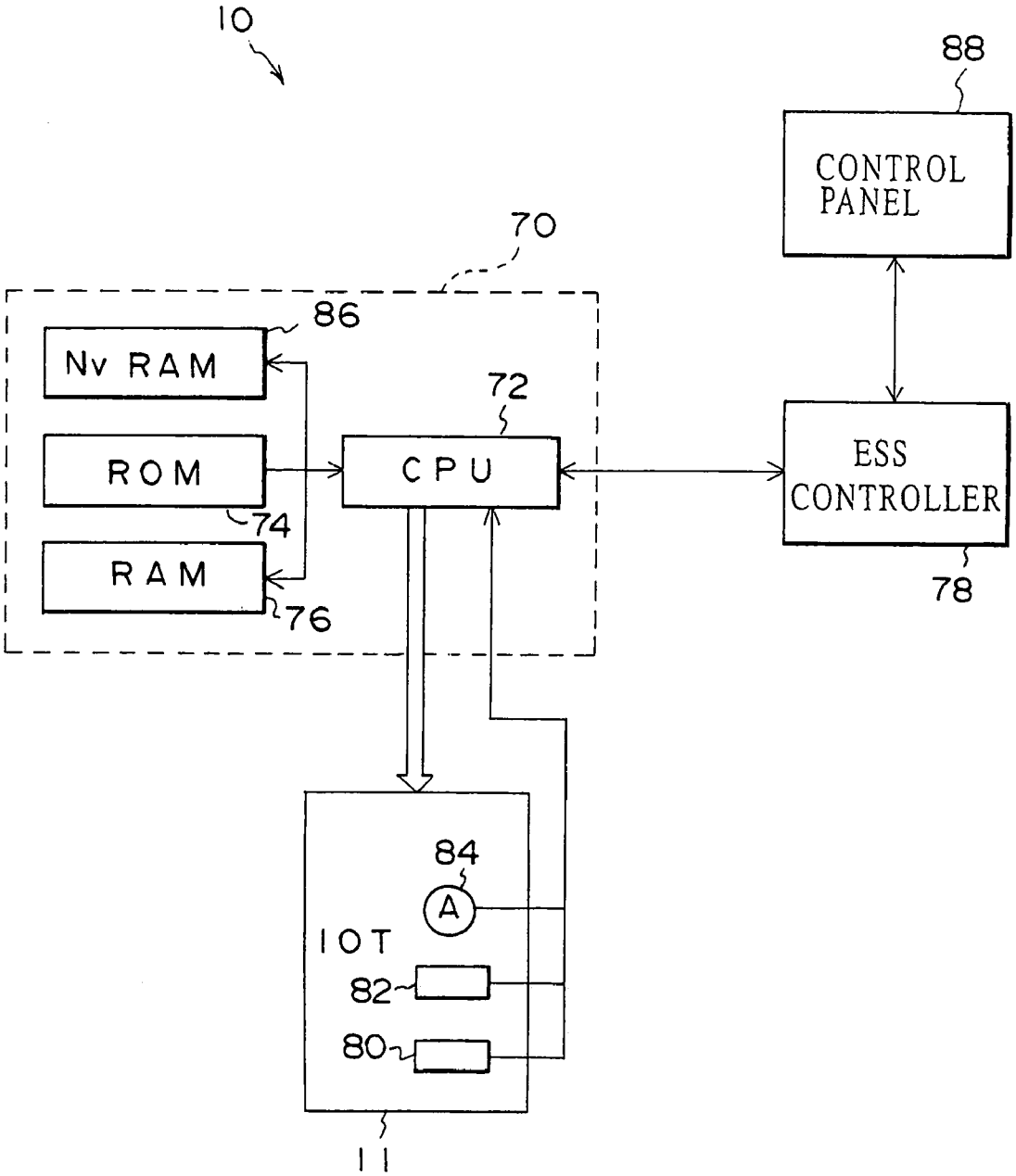
FIG. 3 is a block diagram showing general structure of the laser printer.

Now, as shown in FIG. 3, the laser printer 10 is provided with an IOT controller 70 which, along with controlling operations of the IOT 11, is equipped with a function of capability maintenance control, in order to maintain capabilities for image formation on the paper 36 at times of operation of the IOT 11.

The IOT controller 70 is generally structured to include a CPU 72, ROM 74 and RAM 76. The IOT controller 70 is connected with an electric subsystem (ESS) controller 78 via an unillustrated communication interface.

The ESS controller 78 generates various control signals in accordance with various commands (for example, PCM (print commands) and the like) and data outputted from an unillustrated image processing section. These control signals are inputted to the IOT controller 70, and hence formation of an image at the paper 36 in accordance with image data is possible. Here, various programs, such as an application voltage control processing program and the like, and various tables and the like have been stored in the ESS controller 78 in advance.

A temperature sensor 80, for detecting temperature within the apparatus, and a humidity sensor 82, for detecting humidity, are provided at predetermined positions on an outer face of a housing of the IOT 11. The temperature sensor 80 and humidity sensor 82 are connected to the IOT controller 70. Thus, the IOT controller 70 can continuously acquire environmental temperature and environment humidity at times of formation of images at the paper 36. In the structure of the present embodiment, data representing the temperature and humidity is outputted from the IOT controller 70 to the ESS controller 78 at predetermined time intervals. Thus, it is possible for the ESS controller 78 to acquire the environmental temperature and humidity.

At the laser printer 10, application voltage control processing is executed by the ESS controller 78, to control voltages (bias voltages) applied to the final transfer roller 28, the charging roller 40, the primary intermediate transfer rollers 22 and 24, the secondary intermediate transfer roller 26 and the brush roller 42 at times of image formation.

Various tables are obtained and specified to accord with resistance variation characteristics for the respective objects of this control, by measurements using a real-world apparatus, computer simulations based on design specifications of the laser printer 10, or the like, and are stored in the ESS controller 78. The ESS controller 78 uses these tables to determine levels of applied voltages (voltage values).

At one of these tables, for example, for each of environmental conditions, adjustments for progressive corrections of initial parameters over time and maximum values for the progressive corrections are specified. In another table, for example, for each of environmental conditions and for each of pre-specified blocks into which a cumulative processing count is divided, adjustments of corrections in accordance with cumulative print counts are stored, and reductions in daily maximum counts are stored for the respective environmental conditions.

Further, at the ESS controller 78, tables of, for each of the environmental conditions, adjustments to an amount by which a cumulative print count is restored by a rest period (which represents a duration in which image formation operations are temporarily stopped), minimum voltage values and regulation times are stored. Further, tables of, for each of the environmental conditions, a count-up ratio of the cumulative print count (a ratio between single-sided printing and double-sided printing, which takes double-sided printing as its reference), and upper limit values on continuous print counts are stored. Here, these tables are stored respectively for each of the primary intermediate transfer rollers 22 and 24, the secondary intermediate transfer roller 26 and the final transfer roller 28.

On the basis of these tables, the ESS controller 78 specifies bias voltages for the rollers. The IOT controller 70 implements the bias voltages on the basis of such specifications.

In the IOT 11, for example, a constant voltage is applied to the secondary intermediate transfer roller 26 and current flows between the secondary intermediate transfer roller 26 and the final transfer roller 28, which current is detected by a current sensor 84 and indicates a resistance value between the secondary intermediate transfer roller 26 and the final transfer roller 28. Hence, an optimal transfer bias is determined, and a bias voltage for the final transfer roller 28 is specified.

Thus, in the laser printer 10, appropriate bias voltages are specified in accordance with environmental conditions and processing states, and the formation of high-quality images is enabled.

Now, in the IOT 11, in order to excellently transfer toner images to the paper 36 with a continuously constant transfer efficiency, it is necessary to form transfer electric fields with a constant strength between the secondary intermediate transfer roller 26 and the final transfer roller 28 when the paper 36 is passing between the secondary intermediate transfer roller 26 and the final transfer roller 28.

For example, when a toner image of the four colors yellow, magenta, cyan and black is to be transferred to the paper 36 to form a full-color image, a transfer electric field with a greater strength than when a monochrome image (a single-color image) is to be formed, using black toner or the like, is required.

In order to raise transfer efficiency when the paper 36 is pressed against by the secondary intermediate transfer roller 26 with a predetermined nipping gap, the final transfer roller 28 is covered with a resilient layer, resistivity of an outer peripheral portion of which is regulated. In order to apply high voltages, time-progressive variations of a resistance value thereof are caused, and these variations affect the strength of the transfer field.

The above-described formation of images on the paper 36 and progressive changes of resistance values are compensated by the aforementioned specifications of bias voltages at the ESS controller 78.

However, as well as such causes of variations in the transfer field, the transfer field is greatly altered by a resistance value of the paper 36 that is passing between the secondary intermediate transfer roller 26 and the final transfer roller 28.

The resistance value of the paper 36 is greatly affected by water content, and papers with high basis weights tend to have lower resistance values than ordinary paper. Further, transparencies (OHP films) and the like, which have extremely little water absorbency, tend to have higher resistance values than ordinary paper. Thus, the transfer efficiency of a toner image is affected by the type of the paper 36, by temperature and humidity within the laser printer 10, and so forth.

In order to excellently transfer a toner image to the paper 36 and form a high-quality image irrespective of the variations in the various factors mentioned above, it is necessary to apply a bias voltage which is dependent on the resistance value of the paper 36.

Commonly, a transfer voltage (bias voltage) for forming an appropriate transfer field at the paper 36 is as follows.

transfer voltage=(paper size coefficient)×(paper leading end detection coefficient)×(system resistance detection amount)

Accordingly, the paper size coefficient, the paper leading end detection coefficient and the system resistance detection amount are necessary parameters for appropriate transfer of a toner image to the paper 36, and in addition thereto, a coefficient for specifying a charge removal voltage for the paper that is employed is also necessary.

Furthermore, in order to appropriately transfer a toner image, regulation of a conveyance speed according to the paper 36 and a looping amount according to thickness of the paper 36 is also necessary. Accordingly, a parameter regarding whether the conveyance speed of the paper 36 is set to a full speed or is set to a half speed and a coefficient for regulating looping, that is, a looping coefficient for regulating on/off durations of the paper conveyance rollers, are required.

Further still, in order to fix the toner image to the paper 36 with high quality, it is necessary to suitably set a temperature of the fixing unit 34, and an appropriate temperature regulation coefficient of the fixing unit 34 is required parameter.

For the laser printer 10, for each of the various papers 36 that are ordinarily usable, a paper size correction coefficient, a paper leading end detection coefficient, a system resistance detection amount, a paper charge removal voltage-setting correction coefficient, a paper conveyance speed selection coefficient, a loop regulation coefficient, and a fixing temperature regulation coefficient are obtained from the results of prior testing.

An NvRAM 86 is provided at the IOT controller 70 to serve as non-volatile memory. The parameters which are specified in advance for the paper 36 are stored in the NvRAM 86 as correction coefficients for the respective parameters.

Thus, at the IOT controller 70, when operations of the IOT 11 are to be controlled in accordance with bias voltages which are set by the ESS controller 78 and the like, each parameter is corrected in accordance with the correction coefficients stored in the NvRAM 86, whereby the parameters are set to values which enable proper formation of toner images at the paper 36.

In the present embodiment, types of the paper 36 which are used as the sheet-form recording media are set to, as an example, ordinary paper, recycled paper, high-quality paper, thick paper type 1, thick paper type 2, transparencies (films for overhead projectors), envelopes and postcards, and correction coefficients for each of the above-mentioned parameters are recorded in the NvRAM 86 in relation to each of these papers 36.

At the laser printer 10, a control panel 88 is provided which enables various settings using a user interface (UI), and this control panel 88 is connected through the ESS controller 78 to the IOT controller 70.

At the laser printer 10, as the user interface which is employed at the control panel 88, a paper selection mode is specified. With this paper selection mode, selection of the paper 36 that is to be used for image formation, from the papers 36 for which the correction coefficients of the parameters have been preparatorily stored in the NvRAM 86, is enabled.

Figure 4:
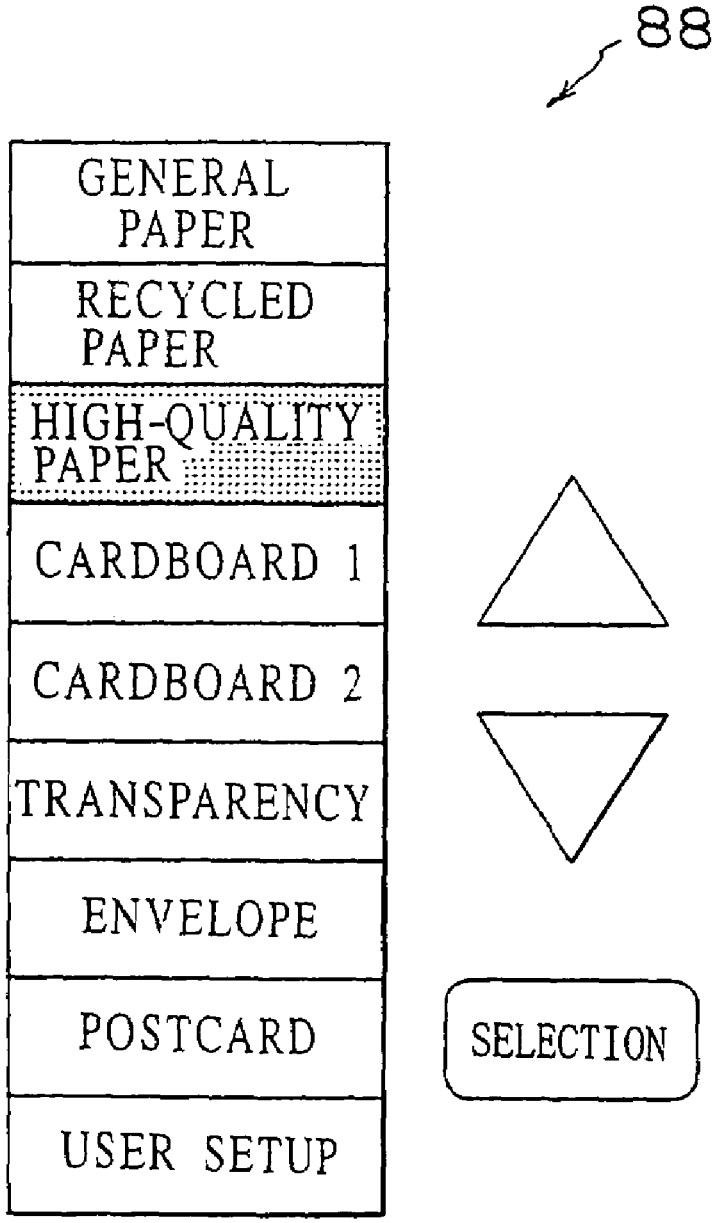
FIG. 4 is a schematic structural view of a user interface which is employed in a paper selection mode at a control panel.

That is, as shown in FIG. 4, in the paper selection mode, it is possible to select any of ordinary paper, recycled paper, high-quality paper, thick paper type 1, thick paper type 2, OHP, envelopes and postcards as the paper 36 at which the laser printer 10 will form an image.

The IOT controller 70 reads out the correction coefficients of the parameters from the NvRAM 86 in accordance with the type of the paper 36 that has been selected in the paper selection mode, corrects control values such as bias voltages and the like in accordance with these correction coefficients, and implements: control of an unillustrated motor for paper conveyance which is provided at the IOT 11 (selection of full speed or half speed); control of output voltages of high-voltage power supplies (the bias voltages); control of setting of a charge removal voltage for the paper 36; adjustment of on/off times of paper rollers (a paper loop clutch); and setting of a target value of fixing temperature in the fixing unit 34. Consequently, regardless of the type of the paper 36, an improvement of transfer efficiency is achieved, and formation of high-quality images is enabled.

Further, a user setting region is provided in the NvRAM 86, for storing correction coefficients when a user sets the correction coefficients for the parameters. Moreover, as shown in FIG. 4, in the paper selection mode, it is possible to select a user setting. This user setting utilizes the data that has been stored in the user setting region of the NvRAM 86 as the correction coefficients for the parameters.

The correction coefficients for the parameters can be inputted to this user setting region of the NvRAM 86 through the control panel 88.

When the IOT controller 70 is set to a mode for writing into the user setting region of the NvRAM 86 and the correction coefficients of the parameters are inputted by operation of unillustrated keys of the control panel 88, the inputted correction coefficients of the parameters are written to the user setting region of the NvRAM 86.

The correction coefficients that are written to the user setting region are reliably preserved in the NvRAM 86 because non-volatile memory is used. Furthermore, when the correction coefficients have been written to the user setting region of the NvRAM 86, selection of the user setting is possible in the paper selection mode.

In the laser printer 10 which is structured thus, prior to image formation onto the paper 36, the ESS controller 78 sets suitable bias voltages and the like in accordance with a state of operation of the laser printer 10 (the IOT 11), temperature and humidity (i.e., environmental temperature and humidity), and so forth. As a result, high-quality image formation at the paper 36 is enabled.

Moreover, in the laser printer 10, the paper selection mode can be executed when an image is to be formed at the paper 36. In this paper selection mode, the paper 36 at which image formation will actually be carried out is selected from the plurality of types of the paper 36 which have been specified beforehand.

In the IOT controller 70 which is provided at the laser printer 10, the correction coefficients of the various parameters which have been specified beforehand for each of the papers 36 are stored in the NvRAM 86. When the paper 36 is selected from the paper selection mode, the IOT controller 70 reads out the correction coefficients of the various parameters relating to the paper 36 that has been selected, and on the basis of these correction coefficients, carries out the setting of the various parameters which is necessary for forming a high-quality image on the paper 36.

When the ITO controller 70 sets the various parameters in accordance with the paper 36, temperature control of the fixing unit 34 (temperature regulation), control of the conveyance speed of the paper 36, paper loop control, control of the paper charge removal voltage and control of the bias voltages are carried out in accordance with the specified parameters, and transfer of a toner image to the paper 36 and fixing processing of the toner image that has been transferred to the paper 36 are implemented.

At this time, because the IOT controller 70 controls the bias voltages so as to form an appropriate transfer electric field in accordance with the paper 36, the toner image can be reliably transferred from the secondary intermediate transfer roller 26 to the paper 36 with high transfer efficiency.

Thus, it is possible to form a high-quality image on the paper 36 with the laser printer 10. At such a time, because the correction coefficients corresponding to the various parameters for forming high-quality images at the paper 36 are stored in the NvRAM 86, it is possible to form the high-quality image at that paper 36 simply by selecting the type of the paper 36 at which the image is actually to be formed or the like, without carrying out complex inputting and setting of parameters and the like.

When the user setting region is provided in the NvRAM 86 which is provided at the IOT controller 70 of the laser printer 10 and, for example, a special type of the paper 36, such as a type of the paper 36 which is coated with a film or the like, is to be used, correction coefficients of the various parameters corresponding to that paper 36 can be inputted from the control panel 88.

When correction coefficients are inputted to the user setting region of the NvRAM 86, selection in the paper selection mode of a user setting that utilizes these correction coefficients that have been inputted to the user setting region is enabled.

Accordingly, a user who will use or may use an unusual paper for which correction coefficients have not been recorded in the NvRAM 86 beforehand may ask a serviceman, customer engineer or the like who carries out maintenance of the laser printer 10 to create the various parameters, correction coefficients and the like to correspond to that special paper. Herein, even for an unusual paper, if it is possible that the paper 36 (the unusual paper) may be used by many users, it is possible to prepare parameters, correction coefficients of the parameters and the like thereof beforehand.

When a user has inputted parameters and/or correction coefficients of parameters relating to a desired unusual paper to the NvRAM 86, it is possible to carry out high-quality image formation using this unusual paper at the laser printer 10 very easily.

Therefore, even when the unusual paper is to be used and when high-quality image formation onto this unusual paper is required because the parameters and/or parameter correction values that have been specified in relation to this unusual paper are written to the NvRAM 86 on the first occasion of use, it is subsequently possible to continue forming high-quality images on the unusual paper with a simple operation which is executed in the paper selection mode.

Now, for the present embodiment, inputting means which uses the control panel 88 to input parameters and/or parameter correction coefficients for an unusual paper by, for example, key operations has been described. However, the inputting means is not limited thus. For example, it is also possible to: connect the laser printer 10 to a network by a conventionally known method, via the ESS controller 78 or the like; implement requests for parameters, parameter correction coefficients and the like for unusual papers through this network; download the requested correction coefficients and the like from a predetermined server or the like; and write these correction coefficients and the like to the NvRAM 86. Thus, unusual papers can be used and high-quality image formation carried out even more easily.

Further, structure of the present invention is not limited to the present embodiment described above. For example, for the present embodiment, an example has been described in which the laser printer 10 carries out image formation on the paper 36 via the photosensitive body drums 14, the primary intermediate transfer rollers 22 and 24, and the secondary intermediate transfer roller 26. However, the present invention is not limited thus. The present invention can be applied to an image formation device with an arbitrary structure that uses an intermediate transfer body with a well-known structure, such as a primary intermediate transfer roller, intermediate transfer belt or the like, to transfer toner images onto various recording sheets and the like, such as the paper 36 or the like, by an electrophotographic process.

According to the present invention as described above, it is possible to form high-quality images easily, by utilizing a non-volatile memory, preparatorily recording various parameters which are specified in advance for respective sheet-form recording media at the non-volatile memory, and selecting a sheet-form recording medium by a simple operation.

Furthermore, with the present invention, an excellent effect is obtained in that, because it is possible to use the inputting means to write parameters and/or parameter correction coefficients to the non-volatile memory, it is possible to easily form high-quality images continuously even on sheet-form recording mediums with unusual materials and the like.

What is claimed is:

1. An image formation device comprising:

an input section for inputting parameters of a sheet-form recording medium irrespective of a predetermined sheet-form recording medium material;

a writing section that writes the parameters inputted by the input section to a user writable region provided in a non-volatile memory;

an image-bearing body at which an electrostatic latent image is formed by a light exposure section;

a development section which forms a toner image in correspondence with the electrostatic latent image at the image-bearing body;

a transfer section which transfers the toner image that has been formed at the image-bearing body to the sheet-form recording medium via an intermediate transfer body, and a fixing section which thermally fixes the toner image that has been transferred by the transfer section to the sheet-form recording medium;

non-volatile memory at which parameters of the transfer section and the fixing section, which change with respective sheet-form recording medium, are preparatory specified and stored in association with the respective sheet-form recording media;

a selection section which selects, from a plurality of sheet-form recording medium for which the parameters are stored at the non-volatile memory, the sheet-form recording medium that is to be used in transfer of the toner image, wherein the selection section is capable of selecting at least one of the parameters that have been written to the user writable region of the non-volatile memory and a sheet-form recording medium specified by these parameters; and a control section which reads from the non-volatile memory the parameters of the sheet-form recording medium that has been selected by the selection section, and controls the transfer section and the fixing section in accordance with the parameters that have been read.

2. The image formation device of claim 1, further comprising:

a primary intermediate transfer body which is in contact with the image-bearing body and to which the toner image is transferred from the image-bearing body; and a secondary intermediate transfer body which is in contact with the primary intermediate transfer body and to which the toner image is transferred from the primary intermediate transfer body, and which is in contact with the sheet-form recording medium and transfers the toner image to the sheet-form recording medium.

3. The image formation device of claim 1, wherein the input section comprises a control panel of a device which is provided with a display section.

4. The image formation device of claim 1, wherein correction coefficients for providing the parameters are recorded at the non-volatile memory.

5. The image formation device of claim 1, wherein the transfer section comprises a portion for controlling a constant voltage on the basis of current detection, and the parameters include a constant voltage control correction coefficient, which sets a transfer voltage of the transfer section.

6. The image formation device of claim 5, wherein the constant voltage correction coefficient comprises a paper size correction coefficient.

7. The image formation device of claim 5, wherein the constant voltage correction coefficient comprises a paper leading end detection correction coefficient.

8. The image formation device of claim 1, wherein the parameters comprise a paper charge removal voltage-setting coefficient.

9. The image formation device of claim 1, wherein the parameters comprise a paper conveyance speed selection coefficient.

10. The image formation device of claim 1, wherein the parameters comprise a loop regulation coefficient.

11. The image formation device of claim 1, wherein the parameters comprise a coefficient for temperature regulation of the fixing section.

12. A process for forming an image, comprising:

forming an electrostatic latent image by light exposure;

forming a toner image in correspondence with the electrostatic latent image;

transferring the toner image that has been formed to a sheet-form recording medium via an intermediate transfer body;

thermally fixing the toner image that has been transferred to the sheet-form recording medium;

beforehand, specifying and storing parameters for respective sheet-form recording medium irrespective of a predetermined sheet-form recording medium material;

selecting the sheet-form recording medium that is to be used during transferring the toner image; and reading the beforehand specified and stored parameters of the sheet-form recording medium that has been selected, and controlling the transferring and the fixing in accordance with the parameters that have been read.

13. The process of claim 12, further comprising recording correction coefficients for providing the parameters.

14. The process of claim 12, wherein the transferring comprises controlling a constant voltage on the basis of current detection, and the parameters include a constant voltage coefficient.

15. The process of claim 14, wherein the constant voltage correction coefficient includes a paper size correction coefficient.

16. The process of claim 14, wherein the constant voltage correction coefficient includes a paper leading end detection correction coefficient.

17. The process of claim 12, wherein the parameters include a paper charge removal voltage-setting coefficient.

18. The process of claim 12, wherein the parameters include a paper conveyance speed selection coefficient.

19. The process of claim 12, wherein the parameters include a loop regulation coefficient.

20. The process of claim 12, wherein the parameters include a coefficient for temperature regulation of a fixing section.

21. An image formation device comprising:

a storage section adapted to store parameters of a sheet-form recording medium irrespective of a predetermined sheet-form recording medium material, wherein the storage section stores at least one parameter relating to a first sheet-form recording medium, at which an image is to be formed, and at least one parameter relating to a second sheet-form recording medium, which is different from the first sheet-form recording medium; and a control section which selects a parameter relating to the first sheet-form recording medium and a parameter relating to the second sheet-form recording medium, which parameters have been stored at the storage section, and controls image formation on the corresponding one of the first sheet-form recording medium and the second sheet-form recording medium.

22. An image formation device comprising:

a first storage section which stores a parameter relating to a first sheet-form recording medium, at which an image is to be formed; and a second storage section which is capable of storing a parameter relating to a second sheet-form recording medium, which is different from the first sheet-form recording medium, wherein the parameters relating to the first and second sheet-form recording mediums are stored irrespective of a predetermined sheet-form recording medium materials.

23. A selection device for selecting a sheet-form recording medium to be used in an image formation device irrespective of a predetermined sheet-form recording medium material, wherein the image formation device forms an image on the sheet-form recording medium in accordance with image data which has been inputted from outside the image formation device, the selection device comprising:

a first display section, which displays information about a first sheet-form recording medium, at which an image is to be formed by the image formation device;

a second display section, which displays information about a second sheet-form recording medium, which is different from the first sheet-form recording medium; and a selection processing section for selecting one of the first display section and the second display section.

24. A selection device for selecting a sheet-form recording medium to be used in an image formation device irrespective of a predetermined sheet-form recording medium material, wherein the image formation device forms an image on the sheet-form recording medium in accordance with image data which has been inputted from outside the image formation device, the selection device comprising:

a first display section, which displays information about a first sheet-form recording medium, at which an image is to be formed by the image formation device;

a second display section, which is capable of displaying information about a second sheet-form recording medium, which is different from the first sheet-form recording medium; and a selection processing section for, when the second sheet-form recording medium is to be specified, selecting one of the first display section and the second display section.

* * * * *